US011856990B2

(12) United States Patent
Chen

(10) Patent No.: US 11,856,990 B2
(45) Date of Patent: Jan. 2, 2024

(54) CAPILLARY LIQUID CONDUCTING AND ATOMIZING UNIT AND ATOMIZING DEVICE

(71) Applicant: Shenzhen Huachengda Precision Industry Co. Ltd., Guangdong (CN)

(72) Inventor: Ping Chen, Guangdong (CN)

(73) Assignee: Shenzhen Huachengda Precision Industry Co. Ltd., Shenzhen (CN)

( * ) Notice: Subject to any disclaimer, the term of this patent is extended or adjusted under 35 U.S.C. 154(b) by 101 days.

(21) Appl. No.: 17/624,247

(22) PCT Filed: Jul. 24, 2020

(86) PCT No.: PCT/CN2020/104539
§ 371 (c)(1),
(2) Date: Dec. 30, 2021

(87) PCT Pub. No.: WO2022/016537
PCT Pub. Date: Jan. 27, 2022

(65) Prior Publication Data

US 2022/0346449 A1 Nov. 3, 2022

(51) Int. Cl.
*A24F 47/00* (2020.01)
*A24F 40/46* (2020.01)
(Continued)

(52) U.S. Cl.
CPC ..... *A24F 40/46* (2020.01); *A24F 40/10* (2020.01); *A24F 40/44* (2020.01)

(58) Field of Classification Search
CPC ..... A24F 40/10; A24F 40/44; A24F 40/46
See application file for complete search history.

(56) References Cited

U.S. PATENT DOCUMENTS 8,707,965 B2 4/2014 Newton
2017/0188629 A1 7/2017 Dickens et al.
(Continued)

FOREIGN PATENT DOCUMENTS

CN 110250576 A 9/2019
CN 209489506 U 10/2019
(Continued)

OTHER PUBLICATIONS

Extended European Search Report of Counterpart European Patent Application No. 20941516.5 dated Aug. 14, 2023.
(Continued)

*Primary Examiner* — Eric Yaary

(57) ABSTRACT

The disclosure provides a capillary liquid conducting and atomizing unit and an atomizing device. The capillary liquid conducting and atomizing unit includes a housing and an atomization assembly arranged in the housing; at least one liquid inlet is provided in a side of the atomization assembly, a capillary liquid absorbing channel communicating with the liquid inlet is provided between an inner side of the housing and the side where the liquid inlet is located; a length direction of the capillary liquid absorbing channel extends along a height direction of the side where the liquid inlet is located, and two opposite ends of the capillary liquid absorbing channel respectively extend towards an upper side and a lower side of the liquid inlet, to absorb liquid into the liquid inlet by capillary action. Thus, the liquid inlet is not required to be arranged at a bottom of the liquid storage reservoir.

16 Claims, 7 Drawing Sheets

(51) Int. Cl.
*A24F 40/10* (2020.01)
*A24F 40/44* (2020.01)

(56) References Cited

U.S. PATENT DOCUMENTS

| | | | | |
|---|---|---|---|---|
| 2021/0227882 | A1* | 7/2021 | Hijma | A24F 40/42 |
| 2021/0368867 | A1* | 12/2021 | Qiu | A24F 40/85 |
| 2022/0192271 | A1* | 6/2022 | Wen | A24F 40/10 |

FOREIGN PATENT DOCUMENTS

| | | | |
|---|---|---|---|
| CN | 110613172 | A | 12/2019 |
| CN | 210782910 | U | 6/2020 |
| EP | 3127441 | B1 | 12/2018 |

OTHER PUBLICATIONS

First Office Action of Counterpart Indian Patent Application No. 202237053696 dated Mar. 24, 2023.

* cited by examiner

CAPILLARY LIQUID CONDUCTING AND ATOMIZING UNIT AND ATOMIZING DEVICE

TECHNICAL FIELD

The present disclosure generally relates to fields of electronic atomization, and more particularly, to a capillary liquid conducting and atomizing unit and an atomizing device.

BACKGROUND

Electronic atomizing devices currently applied in the field of electronic atomization may generally have the problems of liquid leakage and insufficient liquid supply in liquid supply systems thereof. It is difficult to balance the requirements of avoiding liquid leakage and the needs of heating and atomization.

At present, in order to achieve complete atomization of the liquid, a liquid inlet of the atomizing device in the industry is generally arranged at a bottom of a liquid storage reservoir thereof. In this way, a liquid pressure at the liquid inlet is relatively large, and the pressure of the liquid when passing through a porous material is correspondingly large, thus, it is quite easy for the liquid to pass through the porous liquid conducting member, causing the problem of liquid leakage. The liquid leakage can be solved by adjusting a pore size and a pore density of the porous material. However, as the liquid is atomized and evaporated, the liquid in the liquid storage reservoir becomes less, the liquid pressure at the liquid inlet correspondingly becomes smaller. Thus, the speed of the liquid passing through the porous material to reach the atomization surface becomes slower, causing the problem of insufficient liquid supply and further the problem of dry burning. Both the liquid leakage and the dry burning greatly affect the user experience.

SUMMARY OF THE DISCLOSURE

Therefore, the present disclosure aims to provide a capillary liquid conducting and atomizing unit for absorbing liquid by capillary action and an atomizing device having the capillary liquid conducting and atomizing unit.

A capillary liquid conducting and atomizing unit, including a housing and an atomization assembly arranged in the housing; wherein at least one liquid inlet is provided in a side of the atomization assembly, and a capillary liquid absorbing channel communicating with the liquid inlet is provided between an inner side of the housing and a side of the atomization assembly where the liquid inlet is located; and a length direction of the capillary liquid absorbing channel extends along a height direction of the side where the liquid inlet is located, and two opposite ends of the capillary liquid absorbing channel respectively extend towards an upper side and a lower side of the liquid inlet, to absorb liquid into the liquid inlet by capillary action.

In an embodiment, the housing includes a tubular body with two opposite ends being opened, and the tubular body is sleeved on and is attached to an outer periphery of the atomization assembly;

a side wall of the tubular body corresponding to the liquid inlet extends outwards relative to the atomization assembly to form a convex wall extending along a length direction of the tubular body, and the capillary liquid absorbing channel is formed between an inner wall surface of the convex wall and the side of the atomization assembly.

In an embodiment, a shape of an outer periphery of the tubular body is arranged corresponding to a shape of an outer periphery of the atomization assembly, which can be circular, polygonal, or oval.

In an embodiment, the convex wall is provided with an air vent communicating with the capillary liquid absorbing channel, and the air vent is located above the liquid inlet.

In an embodiment, one end of the housing is enclosed to form an enclosed end, and the atomization assembly is located on an inner end surface of the enclosed end;

an inner wall surface of the housing includes a first wall surface corresponding to the side of the atomization assembly where the liquid inlet is located, and a gap is formed between the side of the atomization assembly and the first wall surface to form the capillary liquid absorbing channel;

other inner wall surfaces of the housing form a second wall surface that is spaced apart from and corresponding to other sides of the atomization assembly; and a space between the other sides of the atomization assembly and the second wall surface forms a liquid storage cavity and the space communicating with the capillary liquid absorbing channel.

In an embodiment, a step is provided extending from the first wall surface, and the capillary liquid absorbing channel is formed between the side of the atomization assembly where the liquid inlet is located and the step.

In an embodiment, a support base is provided on the inner end surface of the enclosed end of the housing, and the atomization assembly is arranged on the support base; and a space communicating with the liquid storage cavity is defined between an outer periphery of the support base and the inner wall surface of the housing.

In an embodiment, a top of the capillary liquid absorbing channel is flush with or higher than a top edge of the liquid inlet; and a bottom of the capillary liquid absorbing channel is located below the liquid inlet.

In an embodiment, the atomization assembly includes a liquid conducting member, a sleeve sleeved on the liquid conducting member, and at least one heating element arranged in the liquid conducting member, and the liquid inlet is arranged in the sleeve;

an airflow hole is defined in the liquid conducting member and extends through two opposite ends of the liquid conducting member, and the heating element is located on an inner wall surface of the airflow hole.

In an embodiment, the heating element includes a heating body and two electrodes connecting portions connected to one end of the heating body at intervals, and the electrode connecting portions are exposed out of one end of the liquid conducting member for connection with an external power supply.

In an embodiment, the heating body is sheet shaped or spiral shaped, and the electrode connecting portion is an electrode lead or an electrode contact.

The present disclosure further provides an atomizing device, including the above capillary liquid conducting and atomizing unit and a liquid storage reservoir arranged on an outer periphery of the capillary liquid conducting and atomizing unit; wherein, a bottom of the capillary liquid absorbing channel of the capillary liquid conducting and atomizing unit is higher than a bottom surface of the liquid storage reservoir.

By arranging the capillary liquid absorbing channel outside the liquid inlet, the liquid outside the atomizing unit can be absorbed into the liquid inlet by capillary action, thus, the liquid inlet is not required to be arranged at a bottom of the liquid storage reservoir and thus avoids the liquid leakage. Further, the liquid in the bottom of the liquid storage reservoir can be absorbed into the liquid inlet by capillary action to avoid the problem of dry burning caused by insufficient supply of liquid.

BRIEF DESCRIPTION OF THE DRAWINGS

The present disclosure will be described in more detail with reference to the accompany drawings and the embodiments, wherein in the drawings.

PREFERRED EMBODIMENTS

In order to have a clearer understanding of the technical features, objectives and effects of the present invention, the specific embodiments of the present invention will now be described in detail with reference to the accompanying drawings.

Figure 1:
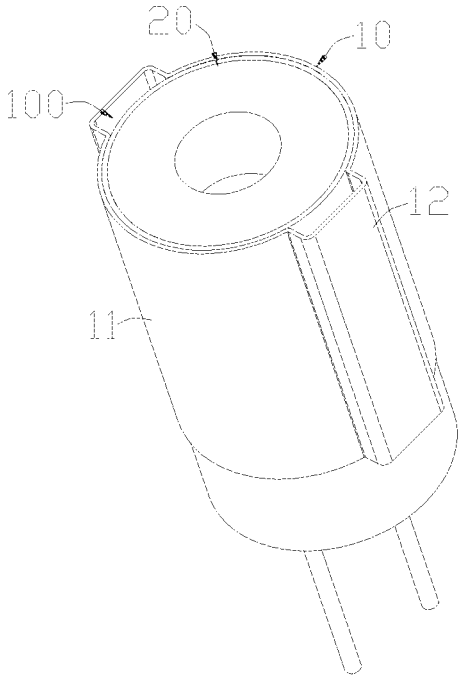
FIG. 1 is a three dimensional view of a capillary liquid conducting and atomizing unit according to a first embodiment of the present disclosure.
Figure 2:
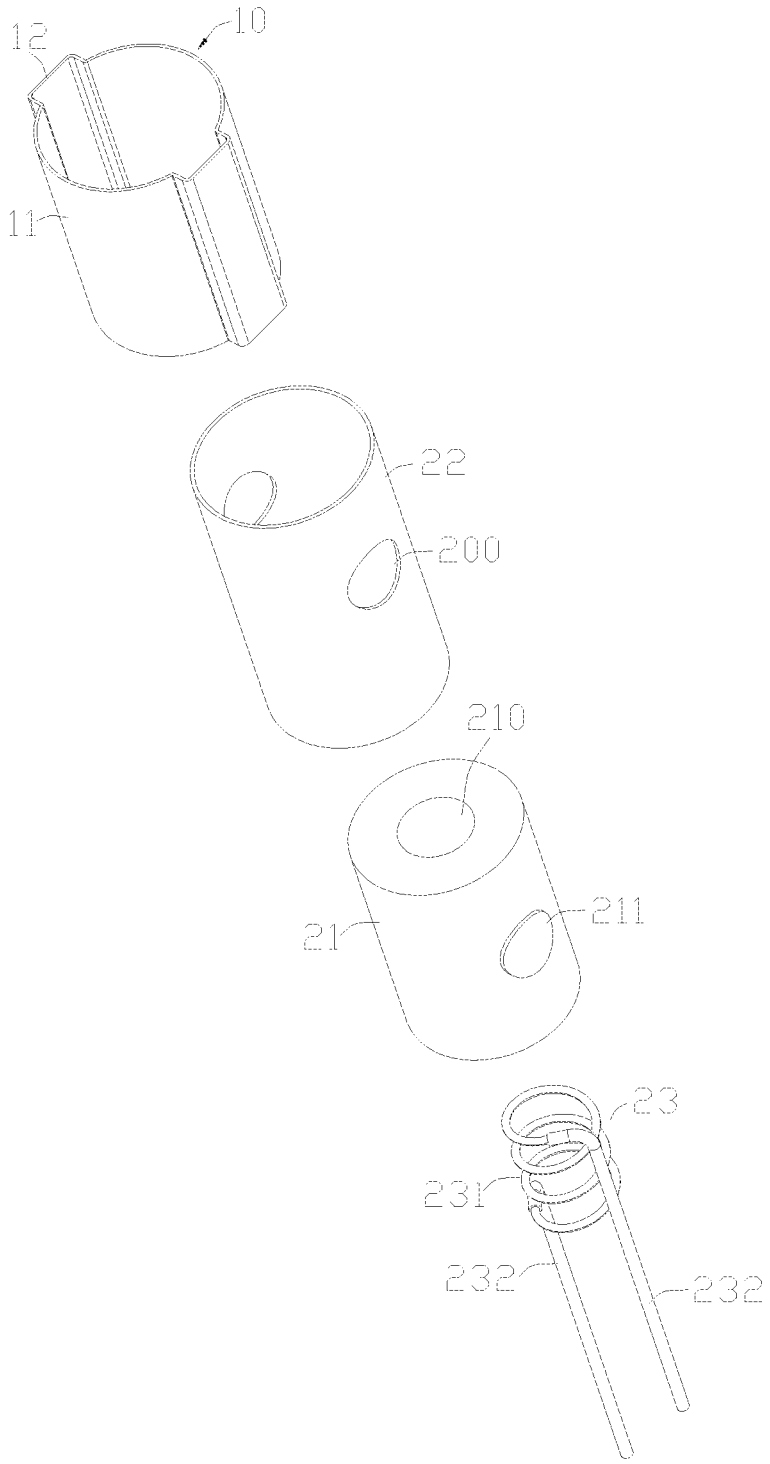
FIG. 2 is an exploded view of the capillary liquid conducting and atomizing unit shown in FIG. 1.
Figure 3:
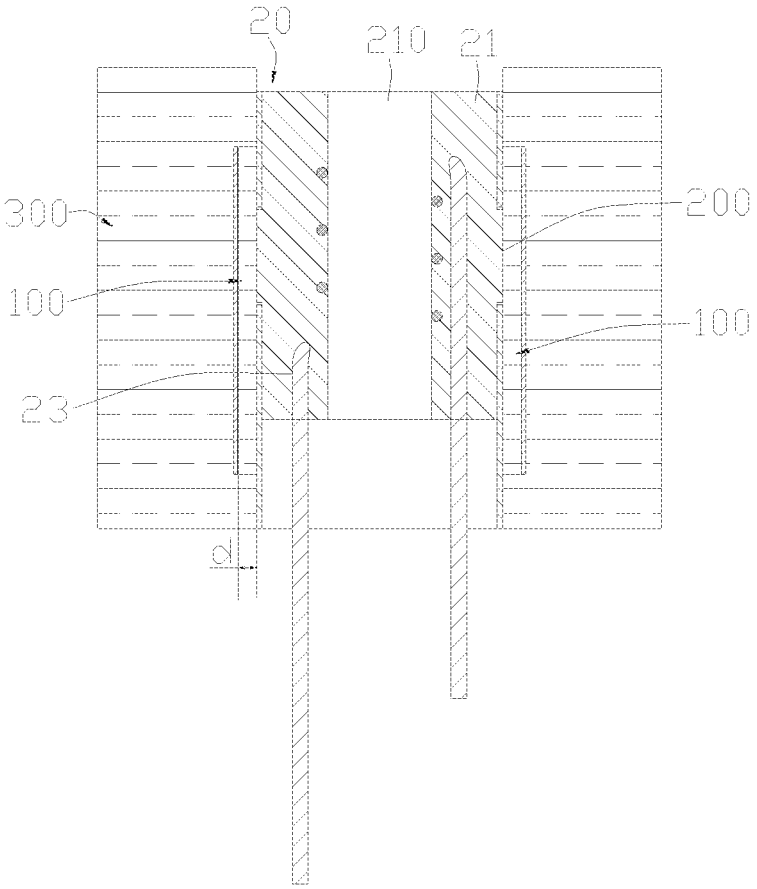
FIG. 3 is a sectional view of the capillary liquid conducting and atomizing unit shown in FIG. 1 for capillary adsorption of liquid.

As shown in FIGS. 1 to 3, a capillary liquid conducting and atomizing unit of a first embodiment of the present disclosure includes a housing 10 and an atomization assembly 20 arranged in the housing 10.

At least one liquid inlet 200 is provided in a side of the atomization assembly 20. A capillary liquid absorbing channel 100 is defined between an inner side of the housing 10 and a side of the atomization assembly 20 where the liquid inlet 200 is located. A length direction of the capillary liquid absorbing channel 100 extends along a height direction of the side of the atomization assembly 20 where the liquid inlet 200 is located. The capillary liquid absorbing channel 100 communicates with the liquid inlet 200, and two opposite ends of the capillary liquid absorbing channel 100 respectively extend towards an upper side and a lower side of the liquid inlet 200, thus, the liquid is absorbed to the liquid inlet 200 through the capillary liquid absorbing channel 100 by capillary action. The liquid entering the liquid inlet 200 is then heated and atomized by the atomization assembly 20 to form smoke.

A width d of the capillary liquid absorbing channel 100 ranges from 0.1 mm to 3 mm. The number of the capillary liquid absorbing channel/channels 100 is correspondingly to that of the liquid inlet/inlets 200. For example, when one liquid inlet 200 is formed in one side of the atomization assembly 20, and one capillary liquid absorbing channel 100 is correspondingly formed. When two liquid inlets 200 are formed in two opposite sides of the atomization assembly 20 respectively, two capillary liquid absorbing channels 100 are formed to respectively correspond to the two liquid inlets 200.

In this embodiment, the housing 10 includes a tubular body 11 with two opposite ends being opened. The tubular body 11 is sleeved on and is attached to an outer periphery of the atomization assembly 20.

A side wall of the tubular body 11 corresponding to the liquid inlet 200 extends outwards relative to the atomization assembly 20 to form a convex wall 12 extending along a length direction of the tubular body 11. The capillary liquid absorbing channel 100 is defined between an inner wall surface of the convex wall 12 and the side of the atomization assembly 20.

A shape of an outer periphery of the tubular body 11 corresponds to that of an outer periphery of the atomization assembly 20, so that the tubular body 11 can closely contact the outer periphery of the atomization assembly 20. The shapes of the outer peripheries the tubular body 11 and the atomization assembly 20 may be, but not limited to a circle, a polygon, an ellipse, or the like. A shape of the convex wall 12 can be but not limited to a square or an arc.

The atomization assembly 20 may include a liquid conducting member 21, a sleeve 22 sleeved on an outer periphery of the liquid conducting member 21, and at least one heating element 23 arranged in the liquid conducting member 21.

The liquid conducting member 21 is used to adsorb liquid to be atomized. The liquid conducting member 21 can be a porous liquid conducting member made of a porous material, and a cross section thereof can be a polygonal, a circular, or other shape. An airflow hole 210 is defined in the liquid conducting member 21 and extends through two opposite ends thereof, and the heating element 23 is arranged on an inner wall surface of the airflow hole 210. The liquid is heated and atomized by the heating element 23 to generate a smoke, and the smoke is output via the airflow hole 210.

The sleeve 22 being sleeved on the outer periphery of the liquid conducting member 21 plays a role of structural support and isolation. The liquid inlet 200 is arranged on the sleeve 22. A protrusion 211 matched in the liquid inlet 200 may be provided on a side of the liquid conducting member 21, such that the liquid conducting member 21 can absorb the liquid better and faster.

The heating element 23 can be attached to or embedded in the inner wall surface of the airflow hole 210, and one end of the heating element 23 is exposed out of one end of the liquid conducting member 21 for connection with an external power supply. The heating element 23 may include a heating body 231 and two electrode connecting portions 232 spaced connected to one end of the heating body 231. The electrode connecting portions 232 are exposed out of the end of the liquid conducting member 21 for connection with the external power supply, and the two electrode connecting portions 232 are configured respectively for connecting to the positive and negative poles of the power supply.

The heating body 231 may be sheet shaped or spiral shaped, and the electrode connection portion 232 may be an electrode lead or an electrode contact. As shown in FIG. 2, in this embodiment, the heating body 231 is a spiral heating tube, and the electrode connecting portion 232 is an electrode lead that extends from one end of the heating tube or being welded on the end of the heating tube.

Furthermore, in this embodiment, a length of the sleeve 22 is greater than that of the liquid conducting member 21, so that the whole liquid conducting member 21 can be received in the sleeve 22. The length of the sleeve 22 is also greater than a length of the housing 10, and the housing 10 is sleeved on the outer periphery of the sleeve 22 corresponding to the liquid inlet 200. A top of the housing 10 is flush with or higher than a top edge of the liquid inlet 200, so that a top of the capillary liquid absorbing channel 100 is flush with or higher than the top edge of the liquid inlet 200. A bottom of the housing 10 is located below the liquid inlet 200, such that a bottom of the capillary liquid absorbing channel 100 is located below the liquid inlet 200, thus, an opening in the bottom of the capillary liquid absorbing channel 100 can absorb can lift the liquid located below the liquid inlet 200 to the liquid inlet 200, and the liquid entering the liquid inlet 200 is further adsorbed by the liquid conducting member 21.

As shown in FIG. 3, when the capillary liquid conducting and atomizing unit of this embodiment is applied to an atomizing device, a liquid storage reservoir 300 of the atomizing device is arranged on an outer periphery of the capillary liquid conducting and atomizing unit. The liquid inlet 200 on the atomization assembly 20 does not need to be located at a bottom of the liquid storage reservoir 300, and may be located at an intermediate position or other position of the liquid storage reservoir 300. The bottom of the capillary liquid absorbing channel 100 is located in the liquid storage reservoir 300, that is, the bottom of the capillary liquid absorbing channel 100 is higher than a bottom surface of the liquid storage reservoir 300. When the atomizing device is working, the liquid in the liquid storage reservoir 300 is absorbed into the capillary liquid absorbing channel 100, and then enters the liquid conducting member 21 through the liquid inlet 200.

Figure 4:
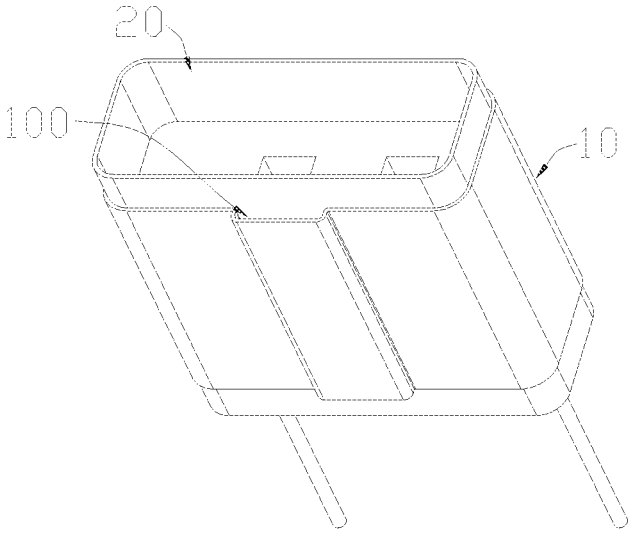
FIG. 4 is a three dimensional view of a capillary liquid conducting and atomizing unit according to a second embodiment of the present disclosure.
Figure 5:
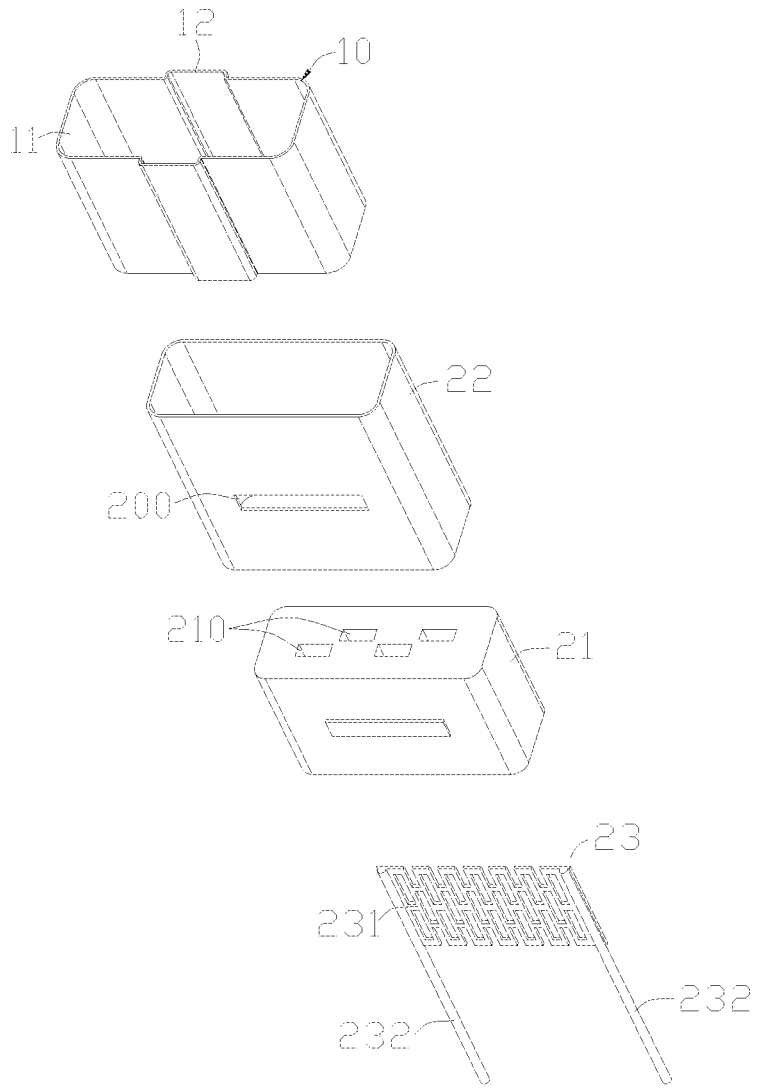
FIG. 5 is an exploded view of the capillary liquid conducting and atomizing unit shown in FIG. 4.

As shown in FIGS. 4 and 5, the capillary liquid conducting and atomizing unit according to the second embodiment of the present disclosure includes a housing 10 and an atomization assembly 20 arranged in the housing 10.

Wherein, at least one liquid inlet 200 is formed in a side of the atomization assembly 20, a capillary liquid absorbing channel 100 is formed between an inner side of the housing 10 and a side of the atomization assembly 20 where the liquid inlet 200 is located. A length direction of the capillary liquid absorbing channel 100 is parallel with a height direction of the side of the atomization assembly 20 where the liquid inlet 200 is located. The capillary liquid absorbing channel 100 communicates with the liquid inlet 200, and two opposite ends of the capillary liquid absorbing channel 100 respectively extend towards an upper side and a lower side of the liquid inlet 200, thus, the liquid can be absorbed to the liquid inlet 200 through the capillary liquid absorbing channel 100 by capillary action. The liquid entering the liquid inlet 200 is then heated and atomized by the atomization assembly to generate smoke.

The housing 10 includes a tubular body 11 with two opposite ends being opened, and the tubular body 11 is sleeved on and attached to an outer periphery of the atomization assembly 20. A side wall of the tubular body 11 corresponding to the liquid inlet 200 extends outwards relative to the atomization assembly 20 to form a convex wall 12 extending along a length direction of the tubular body 11. The capillary liquid absorbing channel 100 is formed between an inner wall surface of the convex wall 12 and the side of the atomization assembly 20 where the liquid inlet 200 is located.

The atomization assembly 20 includes a liquid conducting member 21, a sleeve 22 sleeved on an outer periphery of the liquid conducting member 21, and at least one heating element 23 arranged in the liquid conducting member 21.

In this embodiment, the detailed arrangements of the housing 10 and the capillary liquid absorbing channel 100, the engagement manner between the sleeve 22 and the liquid conducting member 21, etc., can all refer to the above-mentioned first embodiment, and will not be repeated here.

An airflow hole 210 is defined in the liquid conducting member 21, penetrating two opposite ends of the liquid conducting member 21. The heating element 23 can be attached to or embedded in an inner wall surface of the airflow hole 210. One end of the heating element 23 is exposed out of one end of the liquid conducting member 21 for connection with an external power supply. The liquid conducting member 21 may include one or more airflow holes 210 and the multiple airflow holes 210 may be spaced apart. The atomization assembly 30 may include one or more heating elements 23. The multiple heating elements 23 may be independently arranged on the inner wall surface of each airflow hole 210 respectively, or may be arranged on the inner wall surfaces of the same side of the multiple airflow holes 210 by laterally crossing the multiple airflow holes 210.

The heating element 23 may include a heating body 231 and two electrode connecting portions 232 connected to one end of the heating body 231 at intervals. The electrode connecting portions 232 are exposed out of one end of the liquid conducting member 21 for connection with the external power supply, and the two electrode connecting portions 32 respectively correspond to the positive and negative poles of the power supply.

The difference between the second embodiment and the first embodiment lies in that, the heating body 231 of the second embodiment is sheet shaped, and through holes can be further defined in the sheet-shaped heating body 231 to form a hollow sheet as required. The electrode connecting portion 232 may be an electrode lead as shown in FIG. 5, or may be an electrode contact connected or formed on the heating body 231.

The capillary liquid conducting and atomizing unit of this embodiment can be used in an atomizing device, and the capillary liquid conducting method in the atomizing device is the same as that of the above-mentioned first embodiment, which is shown in FIG. 3 and is illustrated in the related description in the above-mentioned first embodiment.

In addition, in the above-mentioned first embodiment, the outer periphery of the atomization assembly 20 may be a circle as shown in FIGS. 1 and 2 or may be other shape such as a square. The outer periphery of the atomization assembly 20 in the second embodiment may be a square as shown in FIGS. 4 and 5, or other shape such as a circle.

Figure 6:
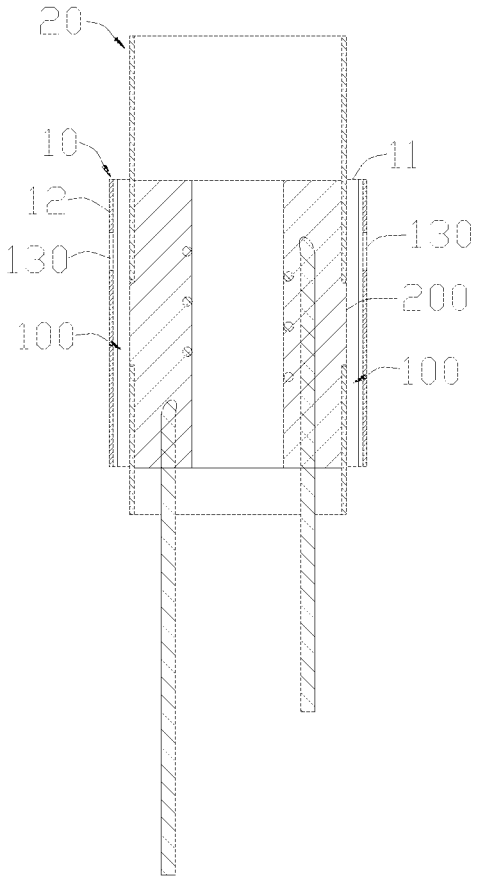
FIG. 6 is a three dimensional view of a capillary liquid conducting and atomizing unit according to a third embodiment of the present disclosure.

As shown in FIG. 6, the capillary liquid conducting and atomizing unit according to a third embodiment of the present disclosure includes a housing 10 and an atomization assembly 20 arranged in the housing 10. The difference between the third embodiment and the above-mentioned first and second embodiments lies in that, the convex wall 12 of the tubular body 11 is provided with an air vent 130 communicating with the capillary liquid absorbing channel 100. The number of the air vent/vents 130 can be one or more. In a vertical direction, the air vent 130 is located above the liquid inlet 200. The arrangement of the air vent 130 can prevent that air in the capillary liquid absorbing channel 100 cannot be discharged to cause that the liquid cannot be well absorbed by capillary action due to the air pressure.

As shown in FIGS. 7 to 10, the capillary liquid conducting and atomizing unit of a fourth embodiment of the present disclosure includes a housing 10 and an atomization assembly 20 arranged in the housing 10.

Wherein, at least one liquid inlet 200 is defined in a side of the atomization assembly 20, and a capillary liquid absorbing channel 100 is formed between an inner side of the housing 10 and a side of the atomization assembly 20 where the liquid inlet 200 is located. A length direction of the capillary liquid absorbing channel 100 extends along a height direction of the side of the atomization assembly 20 where the liquid inlet 200 is located. The capillary liquid absorbing channel 100 communicates with the liquid inlet 200, and two opposite ends of the capillary liquid absorbing channel 100 respectively extend towards an upper side and a lower side of the liquid inlet 200, thus, the liquid can be absorbed to the liquid inlet 200 by capillary action. The liquid entering the liquid inlet 200 is then heated and atomized by the atomization assembly 20 to generate smoke.

A width d of the capillary liquid absorbing channel 100 ranges from 0.1 mm to 3 mm. The number of the capillary liquid absorbing channels 100 corresponds to that of the liquid inlets 200.

In this embodiment, the housing 10 has a tubular structure as a whole, one end of which is enclosed to form an enclosed end 110, and the atomization assembly 20 is positioned on an inner end surface of the enclosed end 110. An outer periphery of the atomization assembly 20 is not in contact with an inner wall surface of the housing 10.

In detail, the inner wall surface of the housing 10 includes a first wall surface 101 corresponding to the side of the atomization assembly 20 where the liquid inlet 200 is located. A gap is defined between the side of the atomization assembly 20 and the first wall surface 101, and the capillary liquid absorbing channel 100 is formed between the side of the atomization assembly 20 and the first wall surface 101. The first wall surface 101 may be a flat surface, or a surface having the same shape as the side of the atomization assembly 20, such as a curved surface or a flat surface.

The other inner wall surfaces of the housing 10 define a second wall surface 102 corresponding to and spaced apart from the other sides of the atomization assembly 20; the space between the other sides of the atomization assembly 20 and the second wall surface 102 forms a liquid storage cavity 103, and the liquid storage cavity 103 communicates with the capillary liquid absorbing channel 100.

Further, a support base 120 is arranged on the inner end surface of the enclosed end 110 of the housing 10, and the atomization assembly 20 is arranged on the support base 120. A space 104 is formed between an outer periphery of the support base 120 and the inner wall surface of the housing 10, and the space 104 communicates with the liquid storage cavity 103.

A through hole 105 is defined in the enclosed end 110 and the support base 120, penetrating two opposite ends of the support base 120 and the enclosed end 110. The through hole 105 is connected to and communicated with the airflow hole 210 of the atomization assembly 20.

The atomization assembly 20 in this embodiment can refer to the atomization assembly 20 of the above-mentioned first embodiment or the second embodiment, which will not be repeated here. Wherein, a lower end of the sleeve 22 of the atomization assembly 20 may be sleeved on an upper end of the support base 120 and may be tightly engaged with the support base 120.

Figure 11:
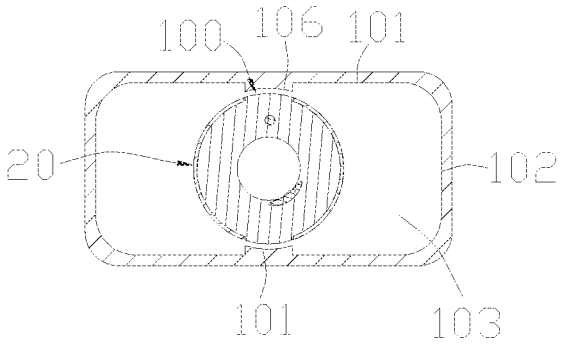
FIG. 11 is a lateral sectional view of a capillary liquid conducting and atomizing unit according to a fifth embodiment of the present disclosure.

As shown in FIG. 11, the capillary liquid conducting and atomizing unit of a fifth embodiment of the present disclosure includes a housing 10 and an atomization assembly 20 arranged in the housing 10. The housing 10, the atomization assembly 20, the capillary liquid absorbing channel 100, etc. refer to the fourth embodiment described above, and will not be repeated here.

The difference between the fifth embodiment and the above-mentioned fourth embodiment lies in that, a step 106 is arranged on the first wall surface 101 of the housing 10, and the capillary liquid absorbing channel 100 is formed between the step 106 and the side of the atomization assembly 20 where the liquid inlet 200 is located. A surface of the step 106 may be a flat surface, or a surface that has the same shape as the side of the atomization assembly 20, such as a curved surface or a flat surface.

For the fourth and fifth embodiments described above, the capillary liquid absorbing channel 100 is mainly formed between two surfaces, and at least three surfaces of the capillary liquid absorbing channel 100 are opened and communicated with the liquid storage cavity 103, such that the three opened surfaces of the capillary liquid absorbing channel 100 can absorb liquid by capillary action.

Referring to FIG. 3, the atomizing device of the present disclosure includes a capillary liquid conducting and atomizing unit and a liquid storage reservoir 300 arranged at an outer periphery of the capillary liquid conducting and atomizing unit.

In one embodiment, the capillary liquid conducting and atomizing unit is the one shown in FIG. 1, FIG. 4 or FIG. 6. In this embodiment, the atomizing device further includes a shell, the capillary liquid conducting and atomizing unit is arranged in the shell, the liquid storage reservoir 300 is formed between the shell and the capillary liquid conducting and atomizing unit, and the liquid storage reservoir may be annular.

Figure 7:
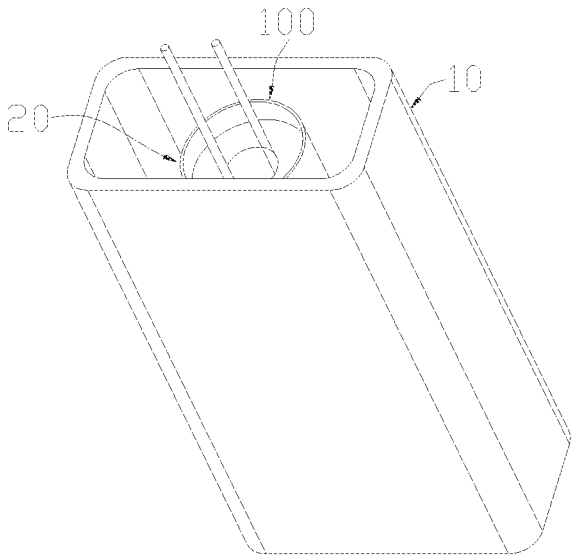
FIG. 7 is a three dimensional view of a capillary liquid conducting and atomizing unit according to a fourth embodiment of the present disclosure.
Figure 8:
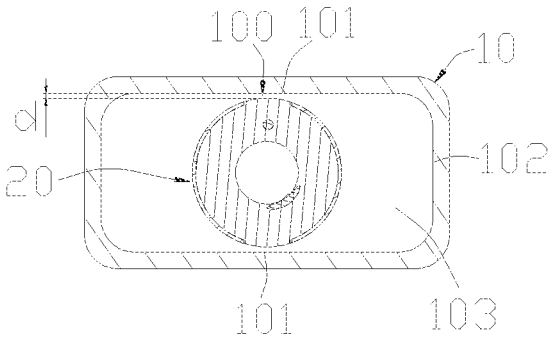
FIG. 8 is a lateral sectional view of the capillary liquid conducting and atomizing unit shown in FIG. 7.
Figure 9:
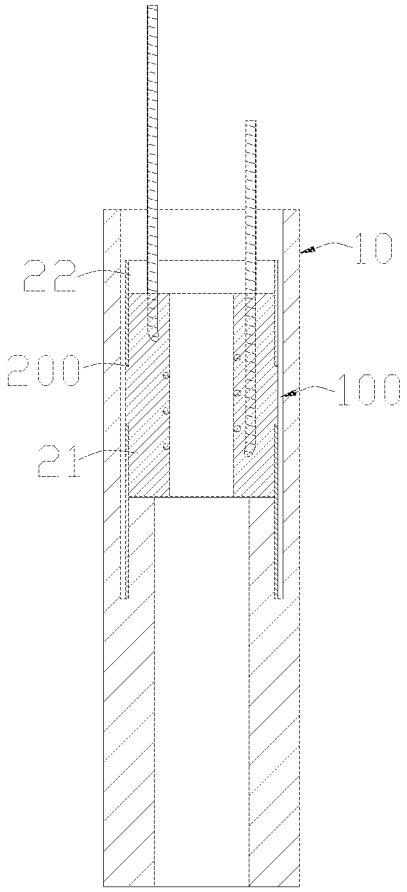
FIGS. 9 and 10 are respectively sectional views of the capillary liquid conducting and atomizing unit shown in FIG. 7 along two different vertical directions.
Figure 10:
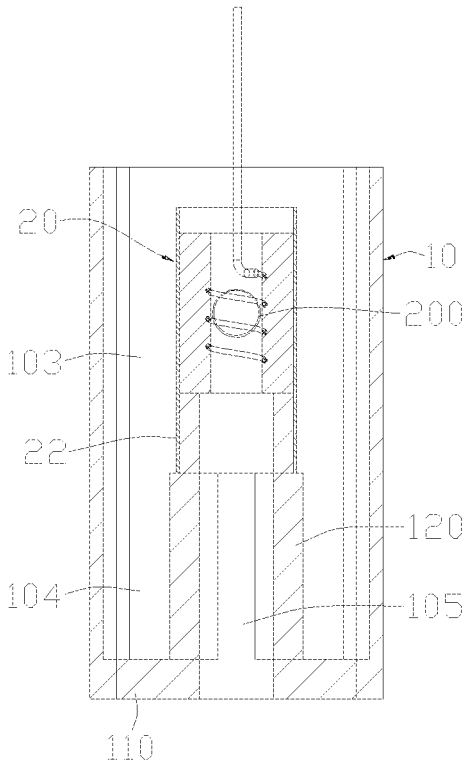

In another embodiment, the capillary liquid conducting and atomizing unit is the one shown in FIG. 7 or FIG. 11. In this embodiment, the housing 10 of the capillary liquid conducting and atomizing unit forms the shell of the atomizing device, and the liquid storage cavity 103 of the capillary liquid conducting and atomizing unit forms the liquid storage reservoir 300 of the atomizing device.

When the atomizing device is working, the liquid in the liquid storage reservoir 300 is absorbed by and into the capillary liquid absorbing channel 100, and then enters the liquid conducting member 21 through the liquid inlet 200. The heating element 23 is energized to generate heat and atomizes the liquid conducted to the heating element 23 to generate smoke. The smoke flows out of the atomizing device through the airflow hole 210.

What mentioned above are only the embodiments of the present disclosure, which are not to limit the scope of the patent of the present disclosure. Any equivalent structure or equivalent transformation of the procedure made with the specification and the pictures attached of the present disclosure, or directly or indirectly using the specification and the pictures attached of the present disclosure into other relevant technical fields, is included in the scope of the patent protection of the present disclosure.

What is claimed is:

1. A capillary liquid conducting and atomizing unit, comprising a housing (10) and an atomization assembly (20) arranged in the housing (10); wherein at least one liquid inlet (200) is provided in a side of the atomization assembly (20), and a capillary liquid absorbing channel (100) communicating with the liquid inlet (200) is provided between an inner side of the housing (10) and a side of the atomization assembly (20) where the liquid inlet (200) is located; and a length direction of the capillary liquid absorbing channel (100) extends along a height direction of the side where the liquid inlet (200) is located, and two opposite ends of the capillary liquid absorbing channel (100) respectively extend towards an upper side and a lower side of the liquid inlet (200), to absorb liquid into the liquid inlet (200) by capillary action; one end of the housing (10) is enclosed to form an enclosed end (110), and the atomization assembly (20) is located on an inner end surface of the enclosed end (110); an inner wall surface of the housing (10) comprises a first wall surface (101) corresponding to the side of the atomization assembly (20) where the liquid inlet (200) is located, and a gap is formed between the side of the atomization assembly (20) and the first wall surface (101) to form the capillary liquid absorbing channel (100); other inner wall surfaces of the housing (10) form a second wall surface (102) that is spaced apart from and corresponding to other sides of the atomization assembly (20); and a first space between the other sides of the atomization assembly (20) and the second wall surface (102) forms a liquid storage cavity (103) communicating with the capillary liquid absorbing channel (100); a support base (120) is provided on the inner end surface of the enclosed end (110) of the housing (10), and the atomization assembly (20) is arranged on the support base (120); a second space (104) communicating with the liquid storage cavity (103) is defined between an outer periphery of the support base (120) and an inner wall surface of the housing (10).

2. The capillary liquid conducting and atomizing unit according to claim 1, wherein the housing (10) comprises a tubular body (11) with two opposite ends being opened, and the tubular body (11) is sleeved on and is attached to an outer periphery of the atomization assembly (20); a side wall of the tubular body (11) corresponding to the liquid inlet (200) extends outwards relative to the atomization assembly (20) to form a convex wall extending along a length direction of the tubular body (11), and the capillary liquid absorbing channel (100) is formed between an inner wall surface of the convex wall (12) and the side of the atomization assembly (20).

3. The capillary liquid conducting and atomizing unit according to claim 2, wherein a shape of an outer periphery of the tubular body (11) is arranged corresponding to a shape of an outer periphery of the atomization assembly (20), which is circular, polygonal, or oval.

4. The capillary liquid conducting and atomizing unit according to claim 2, wherein the convex wall (12) is provided with an air vent (130) communicating with the capillary liquid absorbing channel (100), and the air vent (130) is located above the liquid inlet (200).

5. The capillary liquid conducting and atomizing unit according to claim 1, wherein a step (106) is provided extending from the first wall surface (101), and the capillary liquid absorbing channel (100) is formed between the side of the atomization assembly (20) where the liquid inlet (200) is located and the step (106).

6. The capillary liquid conducting and atomizing unit according to claim 1, wherein a top of the capillary liquid absorbing channel (100) is flush with or higher than a top edge of the liquid inlet (200); and a bottom of the capillary liquid absorbing channel (100) is located below the liquid inlet (200).

7. The capillary liquid conducting and atomizing unit according to claim 1, wherein the atomization assembly (20) comprises a liquid conducting member (21), a sleeve (22) sleeved on the liquid conducting member (21), and at least one heating element (23) arranged in the liquid conducting member (21), and the liquid inlet (200) is arranged in the sleeve (22); an airflow hole (210) is defined in the liquid conducting member (21) and extends through two opposite ends of the liquid conducting member (21), and the heating element (23) is located on an inner wall surface of the airflow hole (210).

8. The capillary liquid conducting and atomizing unit according to claim 7, wherein the heating element (23) comprises a heating body (231) and two electrodes connecting portions (232) connected to one end of the heating body (231) at intervals, and the electrode connecting portions (232) are exposed out of one end of the liquid conducting member (21) for connection with an external power supply.

9. The capillary liquid conducting and atomizing unit according to claim 8, wherein the heating body (231) is sheet shaped or spiral shaped, and the electrode connecting portion (232) is an electrode lead or an electrode contact.

10. An atomizing device, comprising a capillary liquid conducting and atomizing unit, and a liquid storage reservoir (300) arranged on an outer periphery of the capillary liquid conducting and atomizing unit; wherein the capillary liquid conducting and atomizing unit comprises a housing (10) and an atomization assembly (20) arranged in the housing (10); at least one liquid inlet (200) is provided in a side of the atomization assembly (20), and a capillary liquid absorbing channel (100) communicating with the liquid inlet (200) is provided between an inner side of the housing (10) and a side of the atomization assembly (20) where the liquid inlet (200) is located; and a length direction of the capillary liquid absorbing channel (100) extends along a height direction of the side where the liquid inlet (200) is located, and two opposite ends of the capillary liquid absorbing channel (100) respectively extend towards an upper side and a lower side of the liquid inlet (200), to absorb liquid into the liquid inlet (200) by capillary action; and a bottom of the capillary liquid absorbing channel (100) of the capillary liquid conducting and atomizing unit is higher than a bottom surface of the liquid storage reservoir (300); one end of the housing (10) is enclosed to form an enclosed end (110), and the atomization assembly (20) is located on an inner end surface of the enclosed end (110); an inner wall surface of the housing (10) comprises a first wall surface (101) corresponding to the side of the atomization assembly (20) where the liquid inlet (200) is located, and a gap is formed between the side of the atomization assembly (20) and the first wall surface (101) to form the capillary liquid absorbing channel (100); other inner wall surfaces of the housing (10) form a second wall surface (102) that is spaced apart from and corresponding to other sides of the atomization assembly (20); and a first space between the other sides of the atomization assembly (20) and the second wall surface (102) forms a liquid storage cavity (103) communicating with the capillary liquid absorbing channel (100); a support base (120) is provided on the inner end surface of the enclosed end (110) of the housing (10), and the atomization assembly (20) is arranged on the support base (120); a second space (104) communicating with the liquid storage cavity (103) is defined between an outer periphery of the support base (120) and an inner wall surface of the housing (10).

11. The atomizing device according to claim 10, wherein the housing (10) comprises a tubular body (11) with two opposite ends being opened, and the tubular body (11) is sleeved on and is attached to an outer periphery of the atomization assembly (20); a side wall of the tubular body (11) corresponding to the liquid inlet (200) extends outwards relative to the atomization assembly (20) to form a convex wall extending along a length direction of the tubular body (11), and the capillary liquid absorbing channel (100) is formed between an inner wall surface of the convex wall (12) and the side of the atomization assembly (20).

12. The atomizing device according to claim 11, wherein a shape of an outer periphery of the tubular body (11) is arranged corresponding to a shape of an outer periphery of the atomization assembly (20), which is circular, polygonal, or oval.

13. The atomizing device according to claim 11, wherein the convex wall (12) is provided with an air vent (130) communicating with the capillary liquid absorbing channel (100), and the air vent (130) is located above the liquid inlet (200).

14. The atomizing device according to claim 10, wherein a step (106) is provided extending from the first wall surface (101), and the capillary liquid absorbing channel (100) is formed between the side of the atomization assembly (20) where the liquid inlet (200) is located and the step (106).

15. The atomizing device according to claim 10, wherein a top of the capillary liquid absorbing channel (100) is flush with or higher than a top edge of the liquid inlet (200); and a bottom of the capillary liquid absorbing channel (100) is located below the liquid inlet (200).

16. The atomizing device according to claim 10, wherein the atomization assembly (20) comprises a liquid conducting member (21), a sleeve (22) sleeved on the liquid conducting member (21), and at least one heating element (23) arranged in the liquid conducting member (21), and the liquid inlet (200) is arranged in the sleeve (22); an airflow hole (210) is defined in the liquid conducting member (21) and extends through two opposite ends of the liquid conducting member (21), and the heating element (23) is located on an inner wall surface of the airflow hole (210).

* * * * *